US009402417B2

(12) United States Patent
Tosas Fuentes et al.

(10) Patent No.: US 9,402,417 B2
(45) Date of Patent: Aug. 2, 2016

(54) SINGLE LAYER PRINTING METHOD OF PAPER WRAPPER FOR SMOKING ARTICLES

(75) Inventors: Agustin Tosas Fuentes, Barcelona (ES); Pablo De Mariscal Ruigomez, Barcelona (ES)

(73) Assignee: MIQUEL Y COSTAS & MIQUEL, S.A., Barcelona (ES)

( * ) Notice: Subject to any disclaimer, the term of this patent is extended or adjusted under 35 U.S.C. 154(b) by 54 days.

(21) Appl. No.: 14/351,585

(22) PCT Filed: Mar. 7, 2012

(86) PCT No.: PCT/ES2012/070148

§ 371 (c)(1),
(2), (4) Date: Jun. 3, 2014

(87) PCT Pub. No.: WO2013/057339

PCT Pub. Date: Apr. 25, 2013

(65) Prior Publication Data

US 2014/0318563 A1 Oct. 30, 2014

(30) Foreign Application Priority Data

Oct. 17, 2011 (ES) ..... 201131662

(51) Int. Cl.
*A24D 1/02* (2006.01)
*B41M 3/00* (2006.01)
(Continued)

(52) U.S. Cl.
CPC . *A24D 1/02* (2013.01); *A24C 5/005* (2013.01); *B41M 1/04* (2013.01); *B41M 3/006* (2013.01); *B41P 2200/12* (2013.01)

(58) Field of Classification Search
USPC ..... 162/135, 139, 158, 159, 175, 178, 162/181.1; 101/129; 131/365
See application file for complete search history.

(56) References Cited

U.S. PATENT DOCUMENTS 4,984,589 A 1/1991 Riedesser
5,878,754 A * 3/1999 Peterson ..... A24D 1/025 131/349

(Continued)

FOREIGN PATENT DOCUMENTS

EP 1 471 943 4/1977
EP 0 193 607 9/1986

(Continued)

OTHER PUBLICATIONS

International Search Report issued Jul. 4, 2012 in International (PCT) Application No. PCT/ES2012/070148.

(Continued)

*Primary Examiner* — Dennis Cordray
(74) *Attorney, Agent, or Firm* — Wenderoth, Lind & Ponack, L.L.P.

(57) ABSTRACT

The present invention describes a single-layer printing method of a wrapper for smoking articles, so as to obtain a wrapper for smoking articles with low propensity to ignition using the flexographic technique, characterized in that (1) the printing is carried out by means of a central drum flexographic printing machine using a single printing unit, (2) said unit has an anilox with a capacity of between 10 and 40 $cm^3/m^2$ and a printing cylinder equipped with a printing form selected from a stencil plate plus an adhesive, and a sleeve, and (3) in that an ink is used that comprises at least one film-forming substance and a mineral filler. The present invention also relates to the wrapper that can be obtained by this method and to the smoking article that includes said wrapper.

14 Claims, 2 Drawing Sheets

(51) Int. Cl.
*A24C 5/00* (2006.01)
*B41M 1/04* (2006.01)

(56) References Cited

U.S. PATENT DOCUMENTS

| | | | | |
|---|---|---|---|---|
| 6,725,867 | B2 | 4/2004 | Peterson et al. | |
| 7,219,672 | B2 * | 5/2007 | Tosas Fuentes | A24D 1/02 131/365 |
| 2002/0139381 | A1 | 10/2002 | Peterson et al. | |
| 2005/0016556 | A1 * | 1/2005 | Ashcraft | A24D 1/025 131/365 |
| 2007/0246055 | A1 * | 10/2007 | Oglesby | A24D 1/02 131/365 |

FOREIGN PATENT DOCUMENTS

| | | |
|---|---|---|
| EP | 0 251 254 | 1/1988 |
| EP | 0 375 844 | 7/1990 |
| EP | 0 378 774 | 7/1990 |
| EP | 0 864 259 | 9/1998 |
| EP | 1 417 899 | 5/2004 |
| EP | 1 333 729 | 12/2010 |
| WO | 99/51439 | 10/1999 |
| WO | 2009/000499 | 12/2008 |

OTHER PUBLICATIONS

International Preliminary Report on Patentability issued Mar. 20, 2014 in International (PCT) Application No. PCT/ES2012/070148.

* cited by examiner

SINGLE LAYER PRINTING METHOD OF PAPER WRAPPER FOR SMOKING ARTICLES

FIELD OF THE INVENTION

The present invention belongs to the technological field of paper printing, in particular to paper wrappers for smoking articles, more particularly to paper wrappers for self-extinguishing smoking articles (also called "Low Ignition Propensity", or LIP) and specifically to the flexographic printing technique.

STATE OF THE ART

The manufacture of LIP paper wrappers for smoking articles by means of printing strips is based on the transference of a liquid ink from a printing form to the paper. The aim is to stop the cigarette burning when the combustion cone reaches the printed band, under the conditions defined by the ASTM E2187 and ISO 12863 standards. To achieve this goal, the printing has to reduce the gas exchange between the atmosphere and the lit tobacco.

This gas exchange takes place through the pores of the paper and so, the reduction of this gas exchange entails the closure of these pores to a certain extent. This reduction can be measured using air permeability measurements or gas diffusion capacity measurements. To simplify, the term "diffusivity" shall be employed in this specification to mean "diffusion capacity". The instruments currently available to measure diffusivity use carbon dioxide and nitrogen, and they measure the rate of diffusion of the former in the latter, through the printed band.

In the field of paper wrappers for smoking articles, air permeability is measured using the CORESTA n° 40 method, adopted as standard by the industry. This method measures the volume of the air flow passing through a defined surface over a given length of time, when a pressure difference is applied between both faces of the substrate. These measurements are usually given in $ml/min \cdot cm^2$, at a pressure difference of 1 kPa. This is the so-called CORESTA Unit or CU.

On the other hand, the diffusivity, D*, of a gas through a substrate measures the molecular exchange rate between both faces of the substrate, among which there is no pressure difference. Such measurements are usually given in cm/s. Currently, this method is not an industry standard.

One important difference between both measurements is that, whereas the natural permeability of the paper is influenced by all its pores, independently of their size, only small pores, which are approximately up to 10 microns in diameter, influence diffusivity. The pores referred to as "pinholes" in the terminology used in the cigarette paper field, those pores with a size larger than approximately 10 microns in diameter, a size large enough to be visible when the paper is observed through the light, hardly have any influence on diffusivity or on the combustion rate of the cigarette. The latter is evidenced by the fact that when the cigarette paper is perforated using the spark discharge method (known as electrostatic perforation, a process that produces perforations of approximately 10 to 80 microns), the combustion rate of the cigarette does not increase and diffusivity only increases very slightly, no matter how much its air permeability increases. However, the ventilation of the cigarette does increase. Therefore, in theory, diffusivity would be a more suitable measurement of the combustibility of the cigarette than air permeability. Consequently, the industry tends to use it to predict the combustibility of the cigarette with increasing frequency.

In this context, the most relevant parameters defining a cigarette paper wrapper are its permeability to air and its diffusivity, because they correlate best with the smoke ventilation during the consumption of the cigarette by the smoker and with the static combustion rate of the cigarette and therefore, they affect to its tar and nicotine content directly. Higher air permeability and diffusivity values imply a greater open pore area.

On the basis of the above explanation, it is logical to come to the conclusion that the higher the air permeability and the diffusivity of the paper, the greater the need for material applied onto it to achieve the desired reductions of air permeability and diffusivity.

Papers with a high air permeability (of over 50 CU) present the problem of making compatible the amount of solids needed in the ink with its viscosity, because, as mentioned in patent EP1417899, "A very important parameter to be taken into account when printing a paper by any method, is the viscosity of the ink. In techniques such as heliogravure or flexography, there is a limitation related to the viscosity ink, meaning that those inks with high viscosity levels do not facilitate the transfer of the ink to the stretch to be printed, or from there to the printing form or to the paper, depending on the system used. Moreover, a high ink viscosity causes a loss of definition of texts and small drawings. Therefore, when selecting a binder, besides its specific effect of reducing the air permeability of the paper, its ignition tendency and its influence over cigarette taste, the corresponding limitation of viscosity should also be taken into account. As there is a direct relationship between the solid content of a solution and its viscosity, the viscosity limit is interpreted as a limit to the solids in the ink and therefore, a limit to the amount of material applied to the paper."

In order to overcome this problem, the system commonly used applies various consecutive layers to the same area, as described in patent EP 1333729. The main problem this configuration presents is that it is difficult to control the stability of the printing conditions when using various inkwells at the same time. This is why it would be advantageous to use only one inkwell.

EP 1333729 shows as the only advantage of this configuration the reduction of wrinkles produced in any printing using a water-based ink on paper and, even more substantially, when a large amount of ink is applied to a light-weight cigarette paper (about 24/28 $g/m^2$). The present invention is advantageous in that it is not necessary to align the inkwells. This means that the inkwells are aligned in such a way that in the final drawing, the different colors are in exactly the place they should be, so that the drawing is not blurry. This advantage provides a greater control of the operation and makes it more versatile, for example, by allowing to change the inkwell in case problems arise with the inkwell on use.

DESCRIPTION OF THE INVENTION

The object of the present invention is a single-layer printing method of an ink on a wrapper for smoking article, to obtain a wrapper with low propensity to ignition by employing the flexographic technique, characterized in that the printing is carried out using a central drum flexographic printing machine using only one printing group with an anilox with a capacity of between 10 and 40 $cm^3/m^2$ and a printing cylinder equipped with a printing form, also characterized in that an ink is used which comprises at least one film-forming substance and one mineral filler. Said printing form may be a group made of a plastic film known as a stencil plate, glued to the printing cylinder with an adhesive, or a hollow cylinder or sleeve, manufactured from a polymeric material, that is introduced into the printing cylinder.

According to particular embodiments, the film-forming substance is gum arabic.

According to additional particular embodiments, the mineral filler is at least calcium carbonate.

The film-forming substance, preferably gum arabic, may be present in the ink in a percentage comprised between 40 and 95% by weight of the ink solids, preferably between 50 and 90 g/m$^2$ and more preferably between 60 and 85 g/m$^2$, being the upper and lower limits included in all the indicated intervals.

The filler, preferably calcium carbonate, may be present in the ink in a percentage comprised between 5 and 60% by weight of the ink solids, preferably between 10 and 45 g/m$^2$ and more preferably between 15 and 38 g/m$^2$, being the upper and lower limits included in all the indicated intervals.

The ink may furthermore comprise a combustion agent. Said combustion agent may be present in the ink in a percentage comprised between approximately 2% and 10% by weight of the ink solids, preferably between 2.5 and 6 g/m$^2$ and more preferably between 3.4 g/m$^2$ and 3.6 g/m$^2$, being the upper and lower limits included in all the indicated intervals.

According to particular embodiments, the combustion agents may be, for example, salts of organic acids such as citric, maleic, lactic, acetic, tartaric acids and other similar acids. The inventors have found that citric acid salts are especially useful in the invention, especially the metal salts of citric acid such as sodium and potassium citrates and more particularly, potassium citrate.

In the procedure of the invention, between 0.5 and 7 g/m$^2$ of solids are deposited on a paper wrapper for smoking articles, preferably between 0.8 and 4 g/m$^2$ and even more preferably between 1 and 3.8 g/m$^2$, being the upper and lower limits included in all the indicated intervals.

The ink may be applied onto the paper wrapper for smoking articles continuously in straight, wavy or zig-zag bands, or in any other way which ensure that the cigarettes manufactured with this paper wrapper do extinguish.

Using the single-layer printing method of this invention, the areas treated with the ink herein disclosed have a diffusivity of between 0.010 and 0.300 cm/s.

According to a preferred embodiment of the single-layer printing method of this invention, the ink comprises:

between 25% and 40% of solids;

a film-forming substance, namely gum arabic, in a percentage comprised between 40% and 95% by weight relative to the ink solids and;

a filler such as, for example, calcium carbonate, in a percentage comprised between 5% and 60% by weight relative to the ink solids.

According to a particularly preferred embodiment of the single-layer printing method of this invention, the ink comprises:

between 26% and 39% of solids;

gum arabic in a percentage comprised between 62% and 85% by weight relative to the ink solids and;

calcium carbonate in a percentage comprised between 15% and 38% by weight relative to the ink solids.

Printing by means of the flexographic technique with central drum is based on the application of one ink or several inks, using various printing groups placed around a central drum, outside which the material to be printed moves.

Each printing group has:

an engraved cylinder with cells having variable volume and design (known as anilox) and;

a cylinder with the design to be printed in relief (printing cylinder and printing form, respectively).

Other components of each printing group are an ancillary reservoir, pipes, an inkwell and a scraper, or a scraper chamber, according to the specific design of the printing machine.

The ink is transferred to the anilox, the excess ink is removed by means of a scraper, the ink goes to the printing form and from there, to the support to be printed.

If the ink fills all the cells of the anilox and the excess ink is completely removed, the transfer of the ink to the support will be regulated by the pressure between the anilox and printing form, by the pressure between the printing form and the support and by the material and the hardness of the printing form.

Depending on the printing conditions, the ink transfer (the percentage of weight of dry ink on the support over the weight of dry ink on the anilox) may vary between 30% and 50%.

This is a system based on the application of the ink from an embossed form on the support to be printed. Therefore, the pressure of the printing form on the support is a variable that greatly affects the final printing.

On the other hand, the pressure of the anilox on the printing form also influences the final printing, although in a lesser way. For example, a 20 micron increase in the positioning of the anilox relative to the printing form results in a 4.7% reduction in diffusivity.

The influence of the positioning of the printing cylinder relative to the support (that is to say, the pressure of the printing form on the support) on diffusivity is due to two factors:

the transfer of ink to the paper (percentage of weight of dry ink on the paper, over the weight of dry ink in the anilox) and;

the penetration of the ink in the support.

The first factor is regulated by the pressure between the anilox and the printing cylinder and between the printing cylinder and the support. The second factor is regulated by the latter only.

The most important advantages obtained by using a printing method like that of the present invention, which uses only one printing group to obtain a single-layer of ink, as opposed to multi-layer printing methods, are as follows:

1. It is no longer necessary to align printing groups, something necessary in multi-layer printing.
2. It is easier to control the printing operation, as only one printing group has to be managed and controlled.
3. In printing machines equipped with various inkwells or printing groups, the flexibility of the process is higher because it is possible to change from one inkwell to another.
4. Another important advantage of the single-layer printing method is that it saves ink.

The present invention also refers to a wrapper for smoking articles, characterized in that it is obtainable by the method described in this specification.

The present invention also refers to a smoking article that comprises a wrapper obtainable by the method described in this specification.

Figure 1:
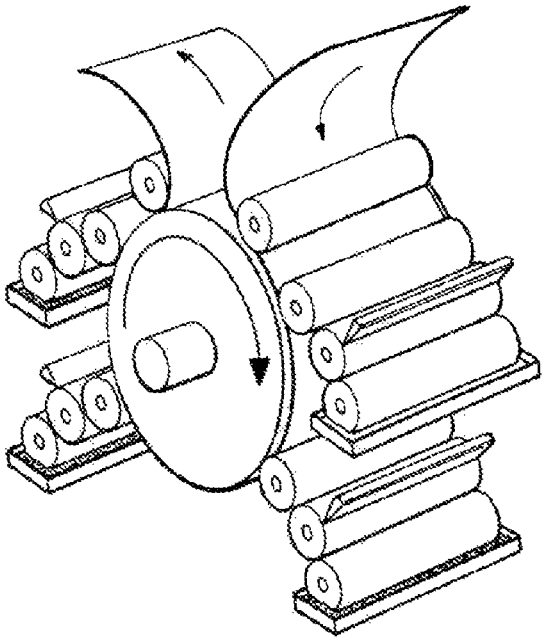
FIG. 1 shows a central drum flexographic printing machine, based on the application of one ink or various inks by means of several printing groups, according to a method of the state of the art, said printing groups being placed around a central drum, outside which the support moves. Each inkwell consists basically of a cylinder (anilox) engraved with cells having variable designs and volume, and a printing cylinder with the design of the form to be printed in relief (the printing cylinder).
Figure 2:
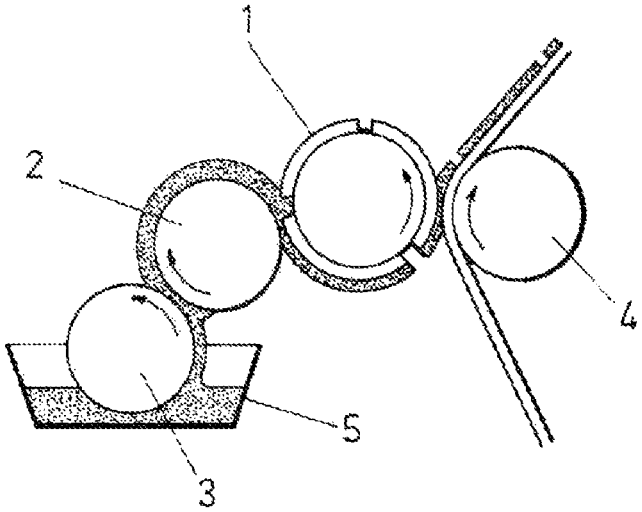
FIG. 2 shows a schematic representation of the flexographic printing technology, in which one can observe how the ink is transferred to the anilox, the excess ink is removed with a scraper and the ink goes from the anilox to the printing form and from there, to the support to be printed.

Numerical references in FIG. 2:

1. Stencil plate and printing cylinder

2. Anilox

3. Transfer cylinder

4. Material carrying cylinder

5. Tray

Figure 3:
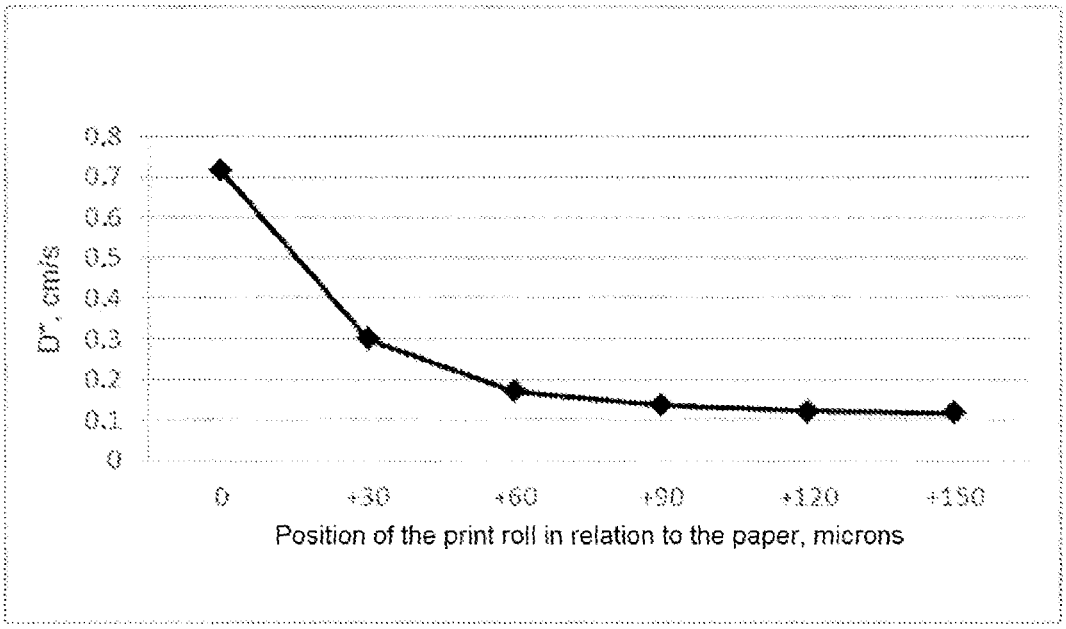

FIG. 3 is a graph obtained using only one inkwell, according to the present invention, with an anilox of a volume of 27 $cm^3/m^2$ and a stencil plate with a Shore hardness of 80A. The graph presents the diffusivity value versus the positioning of the printing cylinder, relative to the support. This graph shows the influence of the pressure of the printing form onto the support. In this figure, the value "0" represents the printing form coming into contact with the paper. +30 represents a forced contact of additional 30 microns of forced contact. +60 represents a forced contact of additional 60 microns, and so on.

Figure 4:
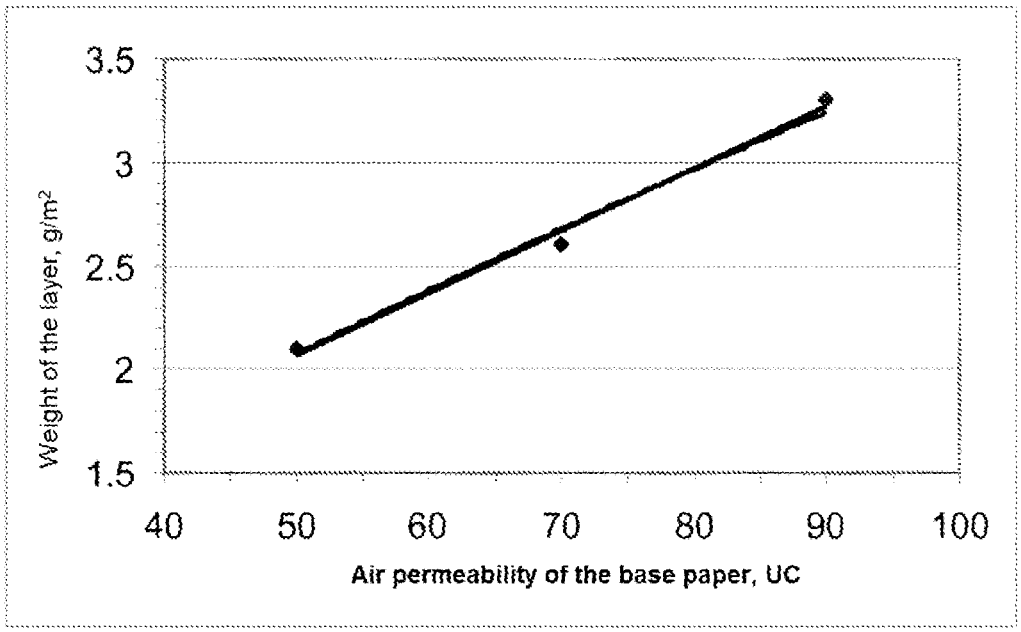

FIG. 4 shows the weight (in $g/m^2$) of the dry matter of ink in the band necessary to obtain 100% self-extinguishment of the cigarettes, according to the ASTM E2187 and ISO 12863 standards, as a function of the air permeability of the base paper. In all these cases, the single-layer printing method was used. The volume of the anilox was changed depending on the weight of the layer required. The ink used had the following characteristics: 35% total solids, consisting of 22.4% gum arabic, 9.1% calcium carbonate and 3.5% potassium citrate.

EXAMPLES

As already stated above, the most relevant parameters defining a cigarette paper are its permeability to air and its diffusivity, given that these parameters correlate best with the static combustion rate of the cigarette and with the smoke ventilation upon the consumption of the cigarette by the smoker. Therefore, they influence directly the tar, nicotine and carbon monoxide contents of cigarettes. Higher air permeability and diffusivity values imply a larger open pore area.

Comparison of a Single-Layer Printing with a Double-Layer Printing

Example 1

Comparison of two flexographic printing machines, one using only one inkwell equipped with a 10.4 $cm^3/m^2$ anilox, and the second one using two inkwells equipped with aniloxes of 16 and 9.5 $cm^3/m^2$, respectively. The ink used in both cases is the same, containing 37% solids consisting of 25.2% gum arabic and 11.8% calcium carbonate. The printing form was a printing cylinder equipped with a 2.84 mm thick stencil plate with a Shore hardness of 80A, glued to the printing cylinder with a 0.20 mm thick adhesive. The paper used had an air permeability of 50 CU. The following table shows the results obtained, the aim being a diffusivity of 0.150 cm/s:

| ANILOX, $cm^3/m^2$ | DIFFUSIVITY, cm/s | LAYER WEIGHT, $g/m^2$ | TYPE OF PRINTING |
|---|---|---|---|
| 16 + 9.5 | 0.175 | 3.4 | DOUBLE LAYER |
| 10.4 | 0.160 | 1.5 | SINGLE LAYER |

The weight of ink needed to obtain a diffusivity of 0.150 cm/s in a paper with an air permeability of 50 CU was of 1.5 $g/m^2$ using the single-layer printing and of 3.4 $g/m^2$ using the double-layer printing, a 126% more.

Example 2

Comparison of two prints made using the same flexographic printing machine, one using just one inkwells with an anilox of 18 $cm^3/m^2$, and the second one using two inkwells with aniloxes, of 18 and 12 $cm^3/m^2$, respectively. The ink used in both cases was the same, containing 37% solids, consisting of 25.2% gum arabic and 11.8 % calcium carbonate. The printing form was a printing cylinder equipped with a 2.84 mm thick stencil plate with a Shore hardness of 80A, glued to the printing cylinder with a 0.20 mm thick adhesive. The paper used had an air permeability of 50 CU. The following table shows the results obtained, the aim being a diffusivity of 0.150 cm/s:

| ANILOX, $cm^3/m^2$ | DIFFUSIVITY, cm/s | LAYER WEIGHT, $g/m^2$ | TYPE OF PRINTING |
|---|---|---|---|
| 18 + 12 | 0.157 | 3.5 | DOUBLE LAYER |
| 18 | 0.161 | 1.9 | SINGLE LAYER |

The weight of ink needed to obtain a diffusivity of 0.150 cm/s in a paper with an air permeability of 50 CU is of 1.9 $g/m^2$ using the single-layer printing and of 3.5 $g/m^2$ using a double-layer printing, a 84% more.

Other Single-Layer Printing Examples

Example 3

A test was carried out using a paper made of 100% wood fiber with an air permeability of 70 CU. Printing was done in a central drum flexographic printing machine using one printing group, with an 18 $cm^3/m^2$ anilox and a printing cylinder equipped with a 1.14 mm thick stencil plate and a Shore hardness of 80A, glued to the printing cylinder with a 0.20 mm thick adhesive. The ink formulation used was 22% by weight of gum arabic, 9.1% by weight of calcium carbonate and 3.5% by weight of potassium citrate (34.6% solids), the rest being water.

The results were as follows, the aim being a diffusivity of 0.150 cm/s:

| ANILOX, $cm^3/m^2$ | DIFFUSIVITY, cm/s | LAYER WEIGHT, $g/m^2$ | TYPE OF PRINTING |
|---|---|---|---|
| 18 | 0.145 | 2.4 | SINGLE LAYER |

Example 4

An experiment was carried out using 100% flax fiber paper with an air permeability of 30 CU. Printing was performed in a central drum flexographic printing machine using one printing group, with a 10.4 $cm^3/m^2$ anilox and a printing cylinder equipped with a 2.84 mm thick stencil plate and a Shore hardness 80A, glued to the printing cylinder with a 0.20 mm thick adhesive. The ink formulation used was 21% by weight of gum arabic, 4.2% by weight of calcium carbonate and 0.8% by weight of potassium citrate (26% solids), the rest being water.

The results were as follows, the aim being a diffusivity of 0.110 cm/s:

| ANILOX, $cm^3/m^2$ | DIFFUSIVITY, cm/s | LAYER WEIGHT, $g/m^2$ | TYPE OF PRINTING |
|---|---|---|---|
| 10.4 | 0.090 | 1.36 | SINGLE LAYER |

Example 5

In this trial, an ink with 38% solids (14.1% of calcium carbonate relative to the weight of the dry material and 23.9% of gum arabic, the rest being water) was applied on a paper with an air permeability of 90 CU. Printing was carried out in a central drum flexographic printing machine using one printing group with a 26 $cm^3/m^2$ anilox and a printing cylinder equipped with a sleeve type printing form with a Shore hardness of 80A.

The results were as follows, the aim being a diffusivity of 0.200 cm/s:

| ANILOX, $cm^3/m^2$ | DIFFUSIVITY, cm/s | LAYER WEIGHT, $g/m^2$ | TYPE OF PRINTING |
|---|---|---|---|
| 26 | 0.170-0.180 | 3.0 | SINGLE LAYER |

Example 6

In this trial, an ink with 39% solids (14.8% calcium carbonate relative to the weight of the dry material and 24.2% gum arabic, the rest being water) was applied on paper with an air permeability of 120 CU. The printing was performed in a central drum flexographic printing machine using one printing group with a 31 $cm^3/m^2$ anilox and a printing cylinder equipped with a sleeve type printing form with a Shore hardness of 80A.

The results were as follows, the aim being a diffusivity of 0.200 cm/s:

| ANILOX, $cm^3/m^2$ | DIFFUSIVITY, cm/s | LAYER WEIGHT, $g/m^2$ | TYPE OF PRINTING |
|---|---|---|---|
| 31 | 0.190-0.200 | 3.8 | SINGLE LAYER |

Example 7

An experiment was done using a paper of 100% flax fiber with an air permeability of 19 CU. Printing was done in a central drum flexographic printing machine using one printing group with a 14 $cm^3/m^2$ anilox and a printing cylinder equipped with a 2.84 mm thick stencil plate with a Shore hardness of 80A, glued to its support by means of a 0.20 mm thick adhesive. The ink formulation used was 25.1% by weight of gum arabic, 5% by weight of calcium carbonate and 0.93% by weight of potassium citrate (31% solids), the rest being water.

The results were as follows, the aim being a diffusivity of 0.110 cm/s:

| ANILOX, $cm^3/m^2$ | DIFFUSIVITY, cm/s | LAYER WEIGHT, $g/m^2$ | TYPE OF PRINTING |
|---|---|---|---|
| 14 | 0.110 | 1.5 | SINGLE LAYER |

Example 8

In this test, an ink with 36% solids (5.4% calcium carbonate relative to the weight of the dry material and 30.6% gum arabic, the rest being water) was applied onto a paper with an air permeability of 80 CU. Printing was carried out using a central drum flexographic printing machine using one printing group with a 26 $cm^3/m^2$ anilox and a printing cylinder equipped with a sleeve type printing form with a Shore hardness of 80A.

The results were as follows, the aim being a diffusivity lower than 0.100 cm/s:

| ANILOX, $cm^3/m^2$ | DIFFUSIVITY, cm/s | LAYER WEIGHT, $g/m^2$ | TYPE OF PRINTING |
|---|---|---|---|
| 26 | 0.069 | 3.02 | SINGLE-LAYER |

The intervals of capacities of the aniloxes (standards of 2 to 35 $cm^3/m^2$, and even higher) and the various designs of the engraved volume, allow high flexibility and ability to print in one single pass papers with a high initial air permeability.

The invention claimed is:

1. A single-layer printing method of water-based ink on a wrapper for smoking articles, with the aim of obtaining a wrapper for smoking articles with low propensity to ignition by the flexographic technique, characterized in that (1) the printing is carried out in a central drum flexographic printing machine using a single printing unit, (2) said unit is equipped with an anilox with a capacity of between 10 and 40 $cm^3/m^2$ and a printing roll equipped with a printing form selected from:

a stencil plate plus an adhesive, and a sleeve, and (3) in that an ink is used, which comprises between 25% and 40% solids, gum arabic in a percentage comprised between 40% and 95% by weight relative to the ink solids, and calcium carbonate in a percentage comprised between 5% and 60% by weight relative to the ink solids.

2. The single-layer printing method, according to claim 1, characterized in that the ink also comprises a combustion agent.

3. The single-layer printing method according to claim 2, characterized in that the amount of combustion agent present in the ink is between 3% and 10% by weight relative to the ink solids.

4. The single-layer printing method according to claim 2, characterized in that the combustion agent is a salt of an organic acids.

5. The single-layer printing method according to claim 4, characterized in that the combustion agent is a metal salt of citric acid.

6. The single-layer printing method according to claim 5, characterized in that the combustion agent is selected from the group consisting of a potassium salt of citric acid and a sodium salt of citric acid.

7. The single-layer printing method according to claim 4, wherein the combustion agent is an organic acid salt selected from the group consisting of citric, maleic, lactic, acetic and tartaric acids and mixtures thereof.

8. The single-layer printing method according to claim 1, characterized in that an amount of between 0.5 and 7 $g/m^2$ of solids are deposited on the wrapper for smoking article.

9. The single-layer printing method according to claim 1, characterized in that the ink is applied to the wrapper for smoking articles continuously.

10. The single-layer printing method according to claim 1, characterized in that the ink is applied to the wrapper for smoking articles in straight, wavy or zigzag band form.

11. The single-layer printing method according to claim 1, characterized in that the ink is applied in such amount that areas treated with it have a diffusivity of between 0.010 and 0.300 cm/s.

12. The single-layer printing method according to claim 1, characterized in that the ink used comprises:

between 26% and 39% solids, gum arabic in a percentage comprised between 62% and 85% by weight relative to the ink solids, and calcium carbonate in a percentage comprised between 15% and 38% by weight relative to the ink solids.

13. A wrapper for smoking article characterized in that is obtainable by the method defined in claim 1.

14. A smoking article characterized in that it comprises a wrapper obtainable by the method described in claim 1.

* * * * *